US007954298B2

(12) United States Patent
Jilg et al.

(10) Patent No.: US 7,954,298 B2
(45) Date of Patent: Jun. 7, 2011

(54) PANEL FOR FLOOR COVERINGS AND WALL AND CEILING LININGS, AND A METHOD FOR PRODUCING THE PANEL

(75) Inventors: Helmut Jilg, Altlengbach (AT); Siegfried Muhr, Stössing (AT)

(73) Assignee: Helmut Jilg, Altengbach (AT)

( * ) Notice: Subject to any disclaimer, the term of this patent is extended or adjusted under 35 U.S.C. 154(b) by 268 days.

(21) Appl. No.: 12/067,613

(22) PCT Filed: Sep. 14, 2006

(86) PCT No.: PCT/AT2006/000380

§ 371 (c)(1),
(2), (4) Date: Jul. 17, 2008

(87) PCT Pub. No.: WO2007/033391

PCT Pub. Date: Mar. 29, 2007

(65) Prior Publication Data

US 2008/0307731 A1 Dec. 18, 2008

(30) Foreign Application Priority Data

Sep. 22, 2005 (AT) ..... 1564/2005

(51) Int. Cl.
*E04G 21/00* (2006.01)
*E04B 1/00* (2006.01)

(52) U.S. Cl. ..... 52/745.19; 52/747.1; 52/741.12; 52/749.1; 144/371; 33/27.031

(58) Field of Classification Search ..... 52/741.1, 52/741.13, 741.15, 741.3, 742.12, 742.13, 52/742.14, 745.05, 745.09, 745.13, 745.15, 52/745.16, 745.19, 746.1, 746.12, 747.1
See application file for complete search history.

(56) References Cited

U.S. PATENT DOCUMENTS 2,018,711 A 10/1935 Elmendorf ..... 52/396.1
(Continued)

FOREIGN PATENT DOCUMENTS

DE 41 10 176 10/1992
(Continued)

OTHER PUBLICATIONS

Austrian Office Action, Austrian Application No. A 1564/2005, mailed Jun. 28, 2006.

(Continued)

*Primary Examiner* — Jeanette E. Chapman
(74) *Attorney, Agent, or Firm* — Fulbright & Jaworski

(57) ABSTRACT

The present invention relates to a method for producing a two-dimensional panel (1) for floor coverings, wall and ceiling coverings, preferably for moisture-prone rooms, comprising the following steps: milling one upper longitudinal groove (6) into a base panel, starting from its useful side (5), the longitudinal groove (6) is filled with an elastic water-repellent plastics or sealing mass (9); and after hardening of the plastics or sealing mass (9), at least one lower longitudinal groove (11) is milled, starting from its rear side (10), the depth of which groove reaching as far as to the sealing mass (9) or into the sealing mass of one of the upper longitudinal grooves (6), thus forming an elastic expansion joint (12) of the panel (1). A further method comprises the following steps: one edge groove (8) each is milled into the base panel, starting from its useful side (5), in the region close to the longitudinal sides (7); the edge grooves (8) are filled with an elastic, water-repellent plastics or sealing mass (9); and after hardening of the plastics or sealing mass (9), a groove (13) as well as a tongue (14) are milled for a groove-and-tongue connection, wherein each of the outer lateral flanks (15) of the sealing mass (9) is milled.

6 Claims, 2 Drawing Sheets

U.S. PATENT DOCUMENTS

| | | | | |
|---|---|---|---|---|
| 2,018,712 | A * | 10/1935 | Elmendorf | 428/168 |
| 2,497,837 | A * | 2/1950 | Nelson | 52/181 |
| 2,725,910 | A * | 12/1955 | Kahr | 144/350 |
| 3,319,392 | A | 5/1967 | Fitzgerald | 52/389 |
| 3,830,899 | A * | 8/1974 | Piccioli et al. | 138/141 |
| 4,944,416 | A * | 7/1990 | Petersen et al. | 52/36.5 |
| 5,486,076 | A * | 1/1996 | Hauschopp | 409/179 |
| 2001/0027828 | A1* | 10/2001 | Hodgskiss | 144/345 |
| 2004/0161574 | A1* | 8/2004 | Hodgskiss | 428/44 |

FOREIGN PATENT DOCUMENTS

| | | |
|---|---|---|
| DE | 296 11 303 | 9/1996 |
| DE | 199 51 812 | 7/2000 |
| DE | 100 45 475 | 4/2002 |
| DE | 203 14 720 | 12/2003 |
| EP | 0 898 031 | 2/1999 |
| EP | 1 593 795 | 11/2005 |
| WO | WO 2004/015221 | 2/2004 |
| WO | WO 2004/042166 | 5/2004 |

OTHER PUBLICATIONS

International Search Report, International Application No. PCT/AT2006/000380, mailed Jan. 16, 2007.

* cited by examiner

PANEL FOR FLOOR COVERINGS AND WALL AND CEILING LININGS, AND A METHOD FOR PRODUCING THE PANEL

This application is a national phase application under 35 U.S.C. §371 of International Application No. PCT/AT2006/000380 filed 14 Sep. 2006, which claims priority to Austrian Patent Application No. A 1564/2005 filed 22 Sep. 2005. The entire text of each of the above-referenced disclosures is specifically incorporated herein by reference without disclaimer.

The invention relates to a method for producing a two-dimensional panel for floor coverings, wall and ceiling coverings, preferably for applications in moisture-prone rooms, as well as to a panel produced according to the inventive method.

For applications in the living, working and moisture-prone area, the specialised trade offers a range of panels, e.g. for production of parquet floors which consist of different materials and comprise different useful layers, depending on price class and field of application. Many such panels consist of a pressboard plate or a wood-fibre plate which has a plastics veneer or real-wood veneer on at least one side, wherein the panels are appropriately cut and are processed to floor coverings as well as to wall and ceiling coverings by the aid of the groove-and-tongue connections formed on the lateral surfaces. Conventional elements are, however, not usable in moisture-prone rooms since the carrying structure of the panels absorbs air humidity and releases the same, and since visible damages occur on the useful side and/or the lateral edges because of the resulting changes in shape due to moisture expansion and shrinking.

A floor or wall covering is known from DE 199 51 812 A1 which consists of several wood elements laid in joint compound structure, wherein the joints between the wood elements are filled with a water-proof, permanent-elastic and non-crack joint material. First, the individual wood components are glued onto an underground (e.g. floor screed) by means of an adhesive bond and, then, the joints between the elements are filled with the elastic joint material. A disadvantage is the relatively large labour effort, which is necessary at the location where the coverings are laid, during preparation of this floor and/or wall covering, in particular as regards filling of the joints with the elastic joint material.

A similarly large labour effort results from the laying of a parquet floor according to DE 100 45 457 A1, wherein individual parquet elements are laid by the aid of a cross joint connector which engages with grooves on the rear side of the individual elements, and wherein the thus developing grooves are filled in situ with a permanent-elastic joint mass.

According to DE 296 11 303 U1 individual wood tiles have a special profile all around the narrow edges, wherein there is a cut dovetail profile on the upper half and vertically a stop edge on the lower half. The joints formed by the dovetail profile are sealed with a joint mass in a water-proof and crack-resistant manner at the place where the coverings are laid.

In DE 41 10 176 A1 a pre-fabricated building-board element, a method for its production, as well as a device for conducting the method are described. When producing the building-board element as set forth in DE 41 10 176 A1, according to a predetermined joint pattern, several individual ceramics plates are fixed on the suction plates of a suction table by means of negative pressure applied onto the suction plates, with their visible side being oriented downwards. Then, from the visible side of the building-plate elements, the joint gaps are sealed against penetration of joint material by means of rubber elements. Thereafter, a hardenable joint mass is introduced into the remaining joint gaps, wherein the building-board element may be removed after hardening of the joint mass and elimination of the negative pressure applied on the suction plates of the suction table. Sealing of the joints between the individual ceramics plates is done by rubber beads projecting in the joint gaps so that after finishing of the building-board element, the joint mass has a concave joint chamfer on the side of the visible side of the building-board element.

A pre-formed floor covering is known from U.S. Pat. No. 2,018,711 A which consists of several individual plates which, according to the main claim, are first glued onto a flexible base by means of an adhesive bond, with the visible side being oriented downwards, wherein interspaces are left between the individual plates. Then, the flexible base with the individual plates glued thereonto is deformed such that the interspaces between plates will open (cf. FIG. 3). Thereafter, an elastic joint mass is introduced into the interspaces, the floor covering is put into a planar position (cf. FIG. 4) and the excessive joint mass is removed. After the joint mass has hardened, the flexible base is removed from the visible side of the preformed floor covering.

Finally, a two-dimensional panel for floor coverings, wall and ceiling coverings, in particular for moisture-prone rooms, is known from WO 2004/042166 A1, wherein the panel may consist of several two-dimensional individual elements made of wood, stone, glass, metal, etc., the lateral surfaces of which forming an interspace which is filled with an elastic, water-repellent plastics or sealing mass. The plastics or sealing mass establishes the adhesive connection between the two-dimensional individual elements and forms a visible structural element at least on the useful side of the panel.

The panel according to WO 2004/042166 A1 is, however, relatively complicated and complex in production, wherein the production comprises the following steps:

- putting several two-dimensional individual elements onto a non-adhesive base, leaving interspaces between the adjacent lateral surfaces of the individual elements;
- fixing the individual elements on the base;
- introducing a water-repellent plastics or sealing mass into the interspaces;
- optionally scraping the excessive plastics or sealing mass; and
- removing the two-dimensional panel after the plastics or sealing mass has hardened.

A further disadvantage resides in that during preparation of parquet floors, movement joints may arise between the abutting lateral surfaces of the panel into which moisture may penetrate.

It is an object of the invention to suggest a method for a two-dimensional panel, which is simple in production, for floor coverings, wall and ceiling coverings or the like, which can also be used in moist areas, wherein a product is to be attained which is attractive in terms of visual appearance and function. A further object is to find an appropriate solution with respect to the movement joints between two abutting panels.

The first object is inventively achieved in that

- at least one upper longitudinal groove is milled into a preferably multi-layered base panel, starting from its useful side,
- the longitudinal groove is filled with an elastic water-repellent plastics or sealing mass, and in that
- after hardening of the plastics or sealing mass, at least one lower longitudinal groove is milled into the panel, starting from its rear side, the depth of which groove reaching as far as to the sealing mass or into the sealing mass of one of the upper longitudinal grooves, thus forming an elastic expansion joint of the panel.

Thus, in contrast to the configuration according to WO 2004/042166 A1, there is no longer the need for tediously putting individual rod-shaped elements onto an appropriate base, leaving equal interspaces, and to then jointing the same with the sealing mass, instead all longitudinal grooves necessary can be milled into a base panel in one procedure step, wherein afterwards the plastics or sealing mass is introduced and the surface is scraped by means of a scraper or the like. The panel is cut as far as to the plastics or sealing mass on one or several sites of the rear side in order to establish an elastic expansion joint.

Thus, the inventive panel distinguishes itself in that it has at least one upper longitudinal groove on its useful side, said groove being filled with a water-repellent plastics or sealing mass, as well as in that the rear side of the panel has at least one lower longitudinal groove which reaches as far as to the sealing mass of one of the upper longitudinal grooves, thus forming an elastic expansion joint of the panel.

The second object is inventively achieved in that one edge groove each is milled into a preferably multi-layered base panel, starting from its useful side, in the region close to the longitudinal sides of the panel, both edge grooves are filled with an elastic, water-repellent plastics or sealing mass, and after hardening of the plastics or sealing mass, a groove as well as a tongue are milled on the longitudinal sides of the panel for a groove-and-tongue connection, wherein each of the outer lateral flanks of the sealing mass is milled.

According to an advantageous embodiment variant of the invention, furthermore, starting from the useful side in the region close to the front sides of the panel, one front groove each is milled, the two front grooves are also filled with an elastic, water-repellent plastics or sealing mass, wherein after hardening of the plastics or sealing mass, a groove as well as a tongue is milled on the front sides of the panel for a groove-and-tongue connection. Here, each of the outer lateral flanks of the sealing mass is milled and laid open.

Thus, a panel is obtained which, on its longitudinal sides and front sides adjacent the useful side of the panel, has a water-repellent plastics or sealing mass which forms an outer framing of the panel. On all lateral and front sides, the panel is lined with the elastic, water-repellent plastics or sealing mass so that a movement joint, which is elastically closed due to the abutting sections of the plastics or sealing mass, is established when joining the panels, e.g. when laying a parquet floor.

On the lateral and front faces of the panels, the plastics or sealing mass forms an effective edge protection during storage, transport and processing. Furthermore, it is prevented that water penetrates into the useful layer from the side and/or gets under the varnish layer during maintenance of parquet floors so that unattractive rims in the region of the joints between the individual panels are prevented.

The inventive panels are excellently suited for floor coverings with floor heating as well as for areas with extreme climatic variations, since all longitudinal and transverse movements are compensated for by the elastic plastics or sealing mass.

The panels may consist of solid wood or comprise a useful layer made of thermally treated or non-treated, domestic and/or foreign hardwood or coniferous wood, e.g. of beech, ash, maple, oak, larch etc. The wood used can be exposed to temperatures between 180° C. and 250° C. in a high-temperature apparatus under controlled atmospheric conditions. With this temperature treatment, a high resistance against fungal and insect infestation is obtained as well as a high dimension stability is reached without the aid of chemical substances, wherein soaking processes and coatings can be completely omitted. Furthermore, dark attractive colourings which remind of precious wood are obtained by the method. Thanks to the thermal method, the degree of moisture expansion and shrinking can be reduced by up to 60%, depending on the kind of wood.

Due to the plastics or sealing mass, preferably made of rubber, natural rubber, polyurethane, etc., a water-repellent panel is formed which is excellently suited for the use in both moisture-prone rooms and terraces. Because of the visually attractive surface, in particular when the plastics mass or sealing mass is of a colour, e.g. black, contrasting the regions where wood is used, an application in all living areas is conceivable. For example, the wood elements may have an oiled surface at least on the useful side of the panel, whereby a product is obtained which is particularly attractive for the living area.

The individual panels are commercially available in packages, as are conventional panels for parquet floors, and may also be laid by do-it-yourselfers as usual.

Preferably, the lateral flanks of the plastics or sealing mass are milled into the edge grooves as well as into the front grooves as far as to their half width so that a joint width is provided when joining the panels that corresponds to the joint width present within the panel.

Furthermore, the inventive method distinguishes itself in that the upper longitudinal grooves and the two edge grooves are produced in one procedure step, wherein each upper longitudinal groove which, together with one of the lower longitudinal grooves, forms an elastic expansion joint, is milled more deeply than the other upper longitudinal grooves. Because of this measure, a better cohesion is achieved in the area of the expansion joint. As a sealing mass, e.g. plastics on the basis of a single-component polyurethane, or a sealing substance on the basis of a polymer (e.g. single or double-component sealing-adhesives on the basis of silicon-modified polymers) is/are used, which sealing-substances have a good adhesive property on wood and are chemically resistant against fresh water and salt water as well as against weak acids and lyes. Moreover, rubber mixtures and natural rubber as well as other suitable plastics with appropriate adhesive properties may be used.

According to a further development of the invention, after filling and hardening of the plastics or sealing mass in the upper longitudinal grooves and the two edge grooves, the useful surface of the panel is smoothed and, optionally, varnished.

A particular advantage of the invention resides in that as a starting product for the inventive method, a semi-finished product from parquet-floor production can be used, e.g. a panel with yet unprocessed longitudinal and front sides, i.e. with no groove and tongue millings.

In addition to the use as a parquet floor, loose floor mats are also conceivable, which, due to the elastic sealing mass, adapt themselves to floor irregularities between the expansion joints of the panel, e.g. on the terrace or in the bathroom and/or sauna area. In this field of application, the panel, on the rear side, may comprise anti-slipping elements applied in a strip-shaped or point-shaped manner or over the whole surface.

When using the invention as loose floor mats or as a floor covering, the outer rims of the panel may be layered with the water-repellent plastics or sealing mass for protection against penetrating moisture, or may also be chamfered or rounded.

In the following, the invention will now be explained in more detail by way of the drawings. Therein:

Figure 1:
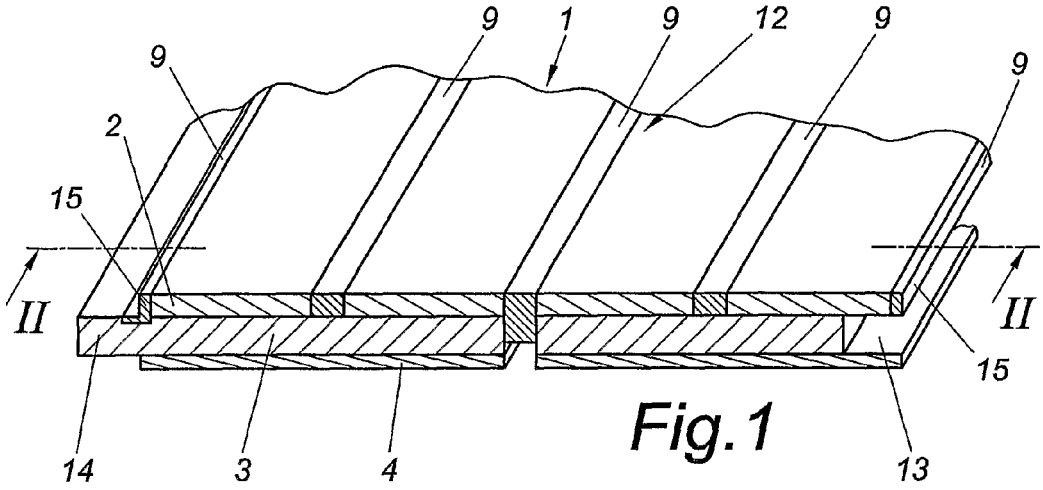
FIG. 1 shows an inventive two-dimensional panel for floor coverings, wall and ceiling coverings in a three-dimensional illustration.
Figure 2:
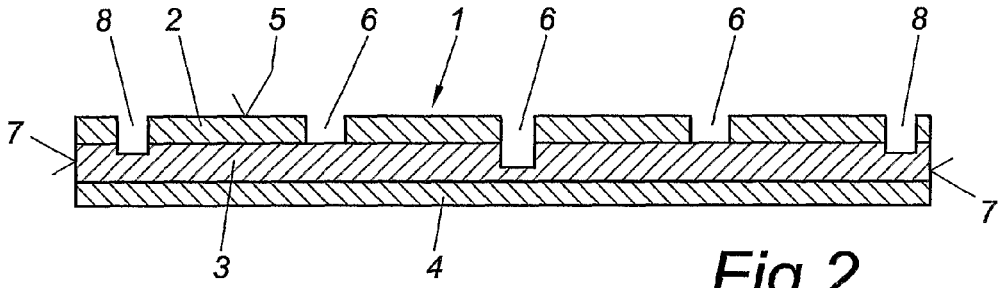
FIG. 2 shows a sectional representation of the panel along line II-II according to FIG. 1 in a first production step.
Figure 3:
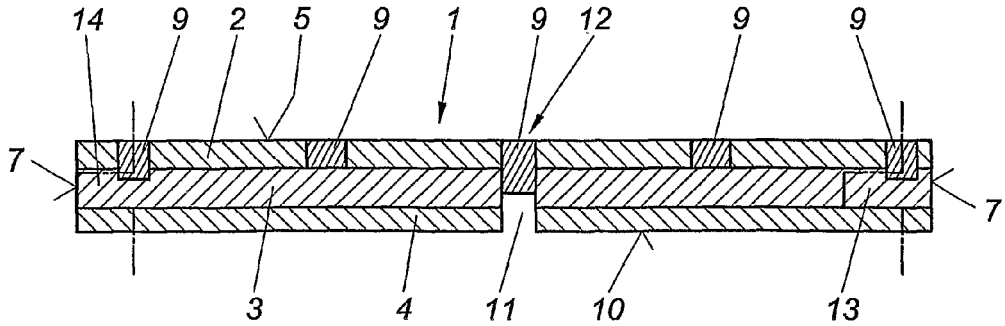
FIG. 3 shows the sectional representation of the panel in a second production step.

The two-dimensional panel 1 which is illustrated in FIGS. 1 to 3 for floor coverings, wall and ceiling coverings has a useful layer 2, a carrying layer 3 and, on the rearside, a counterlayer 4. The individual layers are glued by means of a glue in a known cross-wise way, wherein as a starting product of the production method, preferably a semi-finished product from parquet-floor production can be used, that is, a multi-layered base panel with yet unprocessed longitudinal and front sides.

Such a panel is the basis for FIG. 2. In a first process step, several longitudinal grooves 6 are milled into the multi-layered base panel with equal distances, starting from its useful side 5. Preferably in the same procedure step, one edge groove 8 each is milled in the region close to the longitudinal sides 7 of the panel 1. Then, all longitudinal grooves 6 and the two edge grooves 8 are filled with an elastic, water-repellent plastics or sealing mass 9 (cf. FIG. 3), and the projecting material is removed with a suitable scraping tool. After the plastics or sealing mass 9 has been hardened, at least one lower longitudinal groove 11 is milled into the panel 1, starting from its rear side 10, the depth of which groove reaching as far as to the sealing mass 9, so that the carrying layer 3 is interrupted and an elastic expansion joint 12 is formed in the panel 1.

In a third process step, a groove 13 as well as a tongue 14 are milled on the longitudinal sides 7 of the panel 1 for a groove-and-tongue connection (cf. dot-and-dash lines on the longitudinal sides), wherein in each case the outer lateral flank 15 of the sealing mass 9 in the edge grooves 8 is milled.

The groove-and-tongue connection on the front sides of the panel 1 (not illustrated here) is formed in the same way as on the longitudinal sides 7.

As can be seen from FIGS. 1 and 3, the lateral flanks 15 of the plastics or sealing mass 9 are milled preferably as far as to their half width so that an appearance with equal groove widths is obtained when joining several panels.

As indicated in FIG. 2, the middle one of the upper longitudinal grooves 6, which later forms an elastic expansion joint 12 with a lower longitudinal groove 11, has a deeper milling than the other upper longitudinal grooves lateral to the middle longitudinal groove 6. This results in that the sealing mass 9 in the expansion joint 12 has a larger adhesive surface, and the panel does not crack very easily along the expansion joint 12.

According to the invention, the two edge grooves 8 are milled as far as to the region of the tongue 14 of the groove-and-tongue connection so that the plastics or sealing mass 9 has an L-shaped cross-section in the region of the tongue 14 (cf. FIGS. 1 and 3). Thus, in the compound structure of the individual panels 1 a gap is formed which is well-sealed downwards and whose tightness can be additionally increased by adhesive bonding or gluing. In addition to the groove-and-tongue connection described, also clip or snap-in connections, which require no gluing, as well as any other connection systems are conceivable.

In addition to the example illustrated in FIGS. 1 to 3, many other embodiment variants are possible as well. Accordingly, several expansion joints 12 per panel can be provided in case of broad panels. Furthermore, it is possible to provide only one upper longitudinal groove 6 or also five or seven. In any case, the plastics or sealing mass 9 in the upper longitudinal grooves 6 off the expansion joint 12 reaches substantially only as far as to a boundary surface between the useful layer 2 and the carrying layer 3.

The elastic plastics or sealing mass 9 can be injected into the longitudinal grooves 6 and/or the edge grooves 8 may be injected also from the front side of the panel 1 if the useful side of the panel 1 is covered by a here non-illustrated shaping element, thus forming closed channels for the injection procedure. After injection of the elastic plastics or sealing mass 9 and after its hardening, the shaping element is removed and the useful side 5 of the panel 1 is optionally treated once again.

Figure 4:
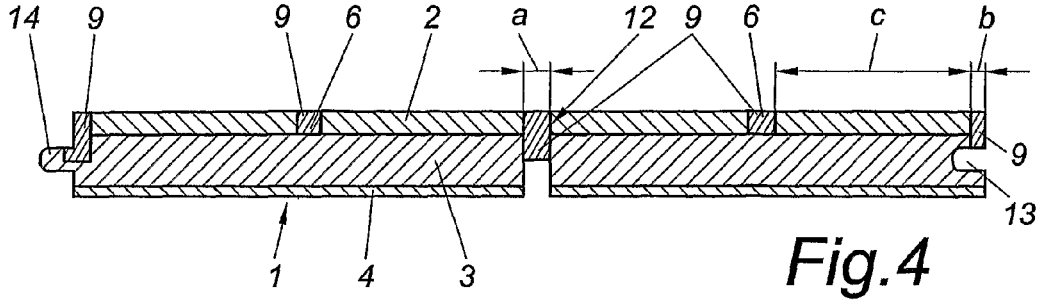
FIG. 4 shows an embodiment variant of the inventive panel in a sectional representation according to FIG. 3.

FIG. 4 shows a typical panel 1 for a parquet floor, wherein the longitudinal grooves 6 and the elastic expansion joint 12 have a width a of 4 mm. The width b of the plastics or sealing mass 9 in the region of the groove 13 and the tongue 14 is 2 mm, the equal distance c between the longitudinal grooves is about 41 mm.

Figure 5:
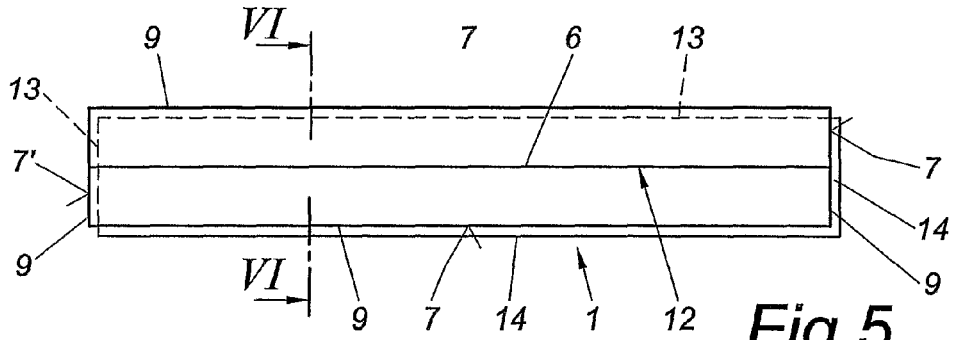
FIG. 5 shows a top view onto a further embodiment variant of the inventive panel.
Figure 6:
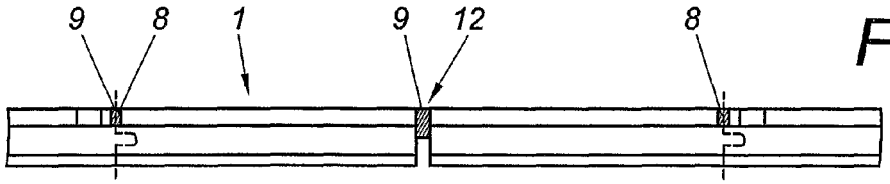
FIG. 6 and FIG. 7 show sectional representations of the panel along line VI-VI in FIG. 5 in an enlarged illustration.
Figure 7:
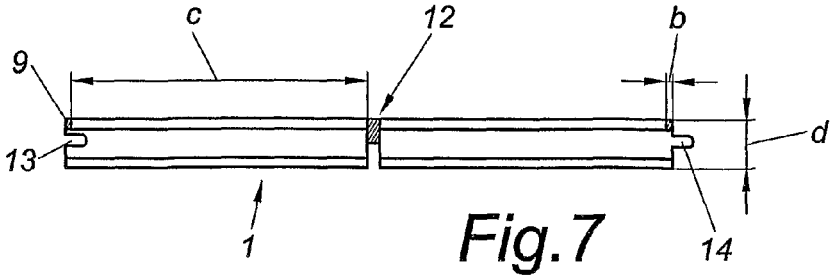

The embodiment variant illustrated in FIGS. 5 to 7 has only one middle longitudinal groove 6 which forms the expansion joint 12. Furthermore, the panel 1, on its longitudinal sides 7 and front sides 7', adjacent the useful side 5 has a water-repellent plastics or sealing mass 9 which forms an outer framing of the panel 1 and protects against water penetration (cf. FIG. 5). The panels may be connected with each other by the aid of an adhesive bond (e.g. single-component sealing mass on the basis of silicon-modified polymers) which is identical with the plastics or sealing mass 9 so that a completely homogeneous structure of the sealing joint between two panels is obtained after hardening.

In FIG. 6, a production step of the panel 1 is illustrated, wherein the longitudinal and edge grooves have been filled and the expansion joint 12 has already been milled. After establishing groove and tongue (cf. dashed line in FIG. 6), the final product shown in FIG. 7 is obtained. Here, the distance c is 86 mm, the width b of the sealing mass 9 on the longitudinal and front sides is 2 mm and the thickness of the panel is 14 mm. In general, the longitudinal grooves filled with the plastics or sealing mass 9 may have a width of between 2 mm and 10 mm, wherein the visible face plates (distance between two longitudinal grooves) have a width of between 10 mm and 200 mm.

The panels 1 may also consist of solid wood or fibre plates or may also be structured in a double-layered and/or multi-layered (e.g. from plywood) way.

The invention claimed is:

1. A method for producing a two-dimensional panel adaptable for floor, wall, and/or ceiling coverings comprising:

milling at least first and second edge grooves into a base panel, wherein each edge groove is in a region close to a longitudinal side of the panel and close to a longitudinal side opposite from the longitudinal side close to the other;

filling both edge grooves with an elastic, water-repellent plastic or sealing mass;

allowing the plastic or sealing mass to harden; and milling a groove and a tongue on the longitudinal sides of the panel, wherein each outer lateral flank of the plastic or sealing masses are milled; and milling at least one of the upper longitudinal grooves in the same procedure as the milling of the first and second edge grooves, and wherein any upper longitudinal groove that will form an elastic expansion joint in the finished panel is milled more deeply than any other upper longitudinal grooves.

2. The method of claim 1, wherein the two edge grooves are milled to a region of the tongue of the groove-and-tongue connection.

3. The method of claim 1, further comprising smoothing the upper side of the panel after filling and hardening of the plastic or sealing mass in the upper longitudinal grooves and the two edge grooves.

4. The method of claim 3, further comprising varnishing the upper side of the panel after smoothing.

5. The method of claim 1, wherein the groove-and-tongue connection is a clip or snap-in connection.

6. A two-dimensional panel adapted for floor, wall, and/or ceiling coverings produced by a method comprising:

milling at least one upper longitudinal groove into an upper side of a multi-layered base panel;

filling the longitudinal groove with an elastic water-repellent plastic or sealing mass;

allowing the plastic or sealing mass to harden; and milling at least one lower longitudinal groove into the panel, wherein the lower longitudinal groove extends to the plastic or sealing mass or into the plastic or sealing mass of the upper longitudinal groove;

wherein an elastic expansion joint of the panel is formed;

wherein the panel is further defined as comprising:

on longitudinal sides and front sides adjacent the upper side of the panel a water-repellent plastic or sealing mass which forms an outer framing of the panel; and a plastic or sealing mass with an L-shaped cross-section in a tongue region adapted to make a groove-and-tongue connection with the other panel.

* * * * *